United States Patent [19]

Fitzpatrick

[11] Patent Number: 4,948,206

[45] Date of Patent: Aug. 14, 1990

[54] REFRIGERATOR DOOR ASSEMBLY WITH DECORATIVE FRONT TRIM PANELS

[75] Inventor: James Fitzpatrick, Chicago, Ill.

[73] Assignee: Ardco, Inc., Chicago, Ill.

[21] Appl. No.: 279,017

[22] Filed: Dec. 2, 1988

[51] Int. Cl.[5] ..... A47B 96/00

[52] U.S. Cl. ..... 312/296; 312/214; 49/402

[58] Field of Search ..... 312/296, 214, 137; 49/401, 402; 52/287, 288, 716

[56] References Cited

U.S. PATENT DOCUMENTS

| | | | |
|---|---|---|---|
| 3,631,630 | 1/1972 | Buffington et al. | 49/402 |
| 3,742,668 | 7/1973 | Oliver | 52/288 |
| 4,104,839 | 8/1978 | Balzer et al. | 52/288 |
| 4,129,971 | 12/1978 | Reusser | 52/288 |
| 4,161,853 | 7/1979 | Weiss et al. | 52/288 |
| 4,248,489 | 2/1981 | Barroero et al. | 312/296 |
| 4,496,201 | 1/1985 | Allgeyer | 312/214 |
| 4,706,426 | 11/1987 | Rumsey | 52/288 |
| 4,741,127 | 5/1988 | Bockwinkel | 312/296 |
| 4,742,664 | 5/1988 | Johnson | 49/501 |

*Primary Examiner*—Kenneth J. Dorner
*Assistant Examiner*—Brian K. Green
*Attorney, Agent, or Firm*—Leydig, Voit & Mayer

[57] ABSTRACT

A refrigerator door assembly mountable in an opening of a refrigerator cabinet including a door mounting cabinet frame having a front wall positionable against the cabinet adjacent the opening and a plurality of insulated glass doors mounted in the cabinet frame. The insulated glass doors each include an insulated glass unit and a door frame surrounding and supporting the periphery of the glass unit. Decorative trim panels, preferably made of plastic, are detachably mounted on the door and cabinet frames in overlapping relation to the front walls thereof for providing the desired finished appearance for the door assembly, which may be color coordinated with the decor of the room or commercial establishment in which the refrigerator is installed.

26 Claims, 1 Drawing Sheet

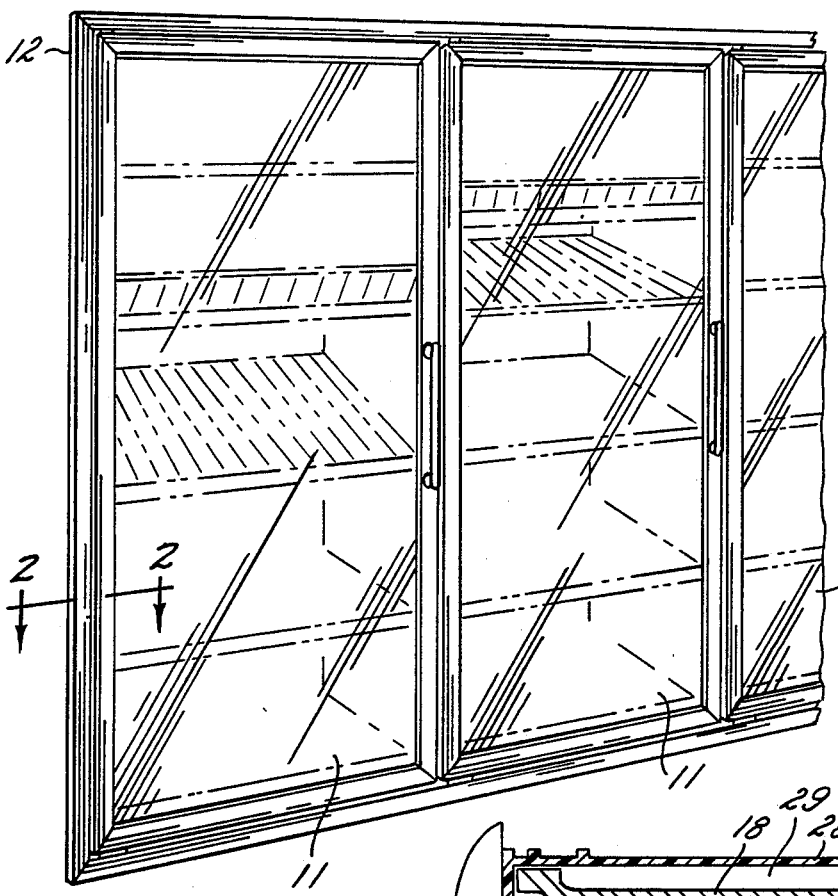
Fig. 1.
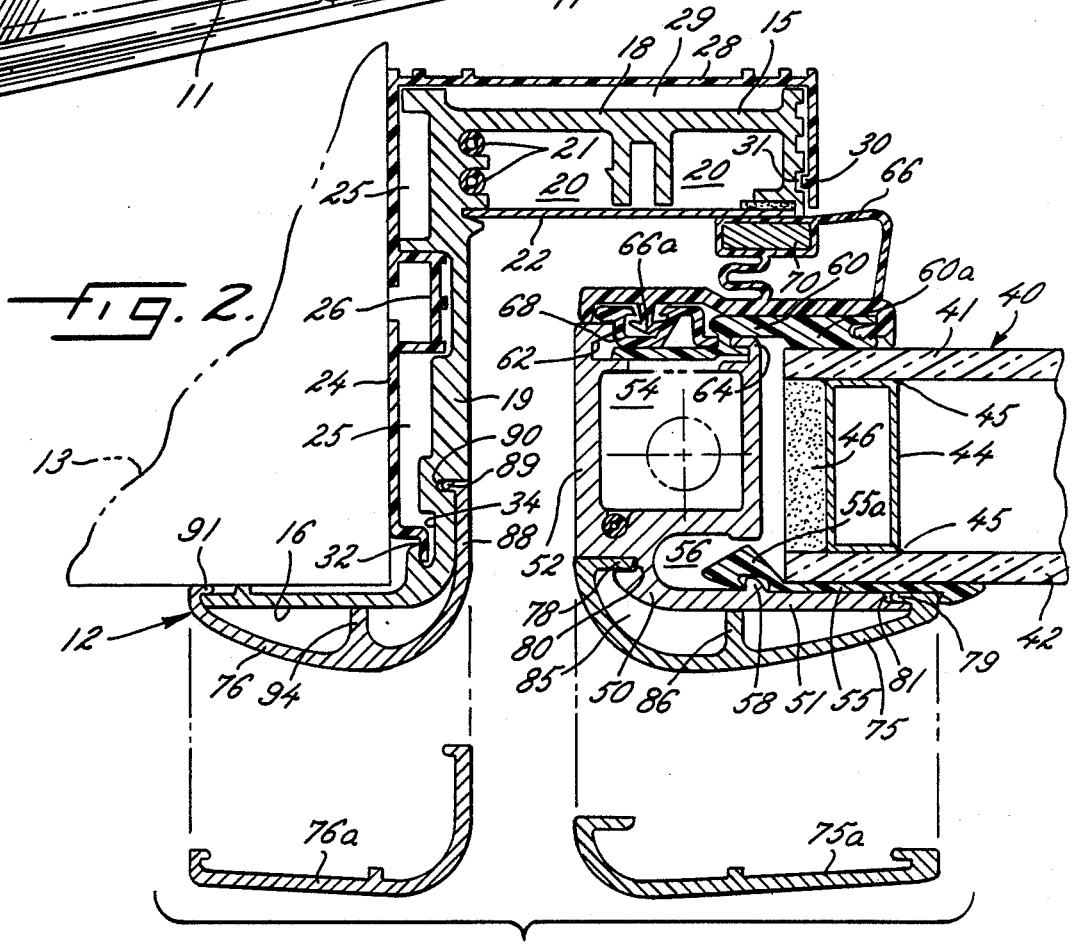
Fig. 2.
Fig. 3.

REFRIGERATOR DOOR ASSEMBLY WITH DECORATIVE FRONT TRIM PANELS

DESCRIPTION OF THE INVENTION

The present invention relates generally to refrigerator and freezer door assemblies, and more particularly to door assemblies of the type used in commercial refrigeration installations.

Commercial refrigerator and freezer doors and their mounting frames typically have an aluminum extrusion surrounding their perimeter to provide both structural support and a finished appearance for the door installation. Such aluminum extrusions generally are silver-like or gold in appearance. In modern supermarkets and other commercial establishments in which refrigerator and freezer display cabinets are used, it is desirable to have a professionally designed decorative surrounding and the typical aluminum extrusion frame of the refrigerator and freezer door assemblies often are not consistent with the decor of the establishment. Moreover, since the refrigerator doors and door mounting frames are subject to considerable abuse in commercial establishments from repeated opening and closing of the doors, the exposed surfaces of frames can become damaged, worn, and unsightly over a period of time. In commercial refrigerator and freezer door assemblies, replacement of the damaged or worn aluminum extrusions is costly, time consuming, and disrupts access to and use of the refrigerator or freezer involved.

It is an object of the present invention to provide a refrigerator and freezer door and mounting frame which lends itself to custom color coordination with the decor of the establishment in which the refrigeration system is installed.

Another object is to provide a refrigerator door and mounting frame as characterized above which can be used to implement the interior decorative design of the commercial establishment in which it is installed.

A further object is to provide a refrigerator door and mounting frame of the foregoing type which permit easy modification in appearance in the event the decor of the establishment is changed, such as during remodeling.

Still another object is to provide such a refrigerator door and mounting frame which have outer decorative panels adapted for easy removal and replacement in the event of damage or unsightly wear so as to permit the refrigerator installation to be maintained with a fresh new appearance.

Other objects and advantages of the invention will become apparent upon reading the following detailed description of a preferred embodiment of the invention and upon reference to the accompanying drawings, wherein:

FIG. 1 is a perspective of a refrigerator door assembly the present invention; and FIG. 2 is an enlarged fragmentary section taken in the plane of line 2—2 in FIG. 1.

FIG. 3 is a sectional top view of an alternate type of decorative trim panels.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Referring now more particularly to the drawings, there is shown an illustrative refrigerator door assembly 10 comprising a plurality of insulated glass doors 11 mounted for swinging movement in a door mounting cabinet frame 12, which in turn is mounted within an opening in a front wall 13 of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12 extends about the periphery of the opening in the wall 13 and includes a plurality of mullions that extend vertically between the top and bottom perimeters of the frame to provide rigidity for the frame 12 and define sealing surfaces against which the free swinging sides of the doors 11 engage when in a closed condition.

The cabinet frame 12 includes a plurality of frame members 15, preferably in the form of extrusions made of aluminum or other suitable metal material, arranged in a rectangular configuration about the periphery of the cabinet opening. The illustrated frame members 15 have a generally Z-shaped configuration comprising a front flange 16, a rear flange 18, and a web 19 extending therebetween. The front and rear flanges 16, 18 project in opposite directions, generally at right angles to the web 19. The rear flange 18 is of a hollow construction so as to define one or more channels 20 which are adapted to receive one or more electrical heating cables 21 for the purpose of maintaining the extrusion at a temperature sufficient to avoid a build up of condensation. The rear flange 18 is provided with a removable cover plate 22 which encloses the channels 20 and provides a sealing surface against which the doors close.

An insulating strip 24, preferably made of plastic, is interposed between the web 19 of the frame member 15 and the cabinet wall 13. The web 19 is formed with a recessed outer side, which together with the insulating strip 24, define dead air, insulating spaces 25. The insulating strip 24 has an inwardly directed channel 26 received in a central recess of the web 18 to insure proper positioning thereof. The insulating strip 24 in this case has an L-shaped leg 28 encompassing the back side and end of the rear flange 18 of the frame member 15. The back side of the rear flange 18 also is recessed so as to define an air insulating space 29. The insulating strip 24 may be positively secured to the frame member 15 prior to mounting within the cabinet opening by snap action engagement of a lug 30 formed at one end of the insulating strip 24 in a slot 31 on the end of the rear flange 18 and by an inwardly turned retaining flange 32 at the opposite end of the insulating strip 24 which engages a recess 34 on the outer side of the web 19.

The insulated glass doors 11 each door 11 include an insulated glass unit 40 comprising a pair of glass panes 41, 42 disposed in parallel side-by-side relation separated by a spacer 44. As is known in the art, the spacer 44 may comprise a plurality of elongated metal tubular members disposed in a rectangular arrangement between the panes 41, 42, in this case each being spaced inwardly a small distance from the peripheral edges of the glass panes. A sealant 45 is provided between the sides of the spacer 44 and the adjacent glass panes 41, 42 for establishing a primary vapor seal, and a layer 46 of a flexible sealant fills the area between the panes about the outer periphery of the spacer 18.

For supporting the glass unit 40, each door 11 has a metal outer frame 50, preferably assembled from a plurality of extrusions made of aluminum or other suitable metal which each are disposed along a respective peripheral side of the glass unit 40. The outer metal frame 50 has a front wall 51 for retaining a front side of the glass unit 40 and an outer and inner side walls 52, 54 disposed in parallel relation adjacent an end of the glass unit 40. An insulating strip 55 is interposed between the front wall 51 of the frame 50 and the glass unit 40. The front wall 51 and inner side wall 54 define a recess 56 for receiving an enlarged outer end **55*a* of the insulating strip, which is formed with a recess for engaging a retaining flange 58 on the inside of the front wall 51**.

To retain the glass unit 40 within the outer metal frame 50, a molding strip 60, preferably made of rigid PVC or like plastic material, is engageable with the rear side of the outer frame 50 and has an inwardly directed leg **60*a* disposed adjacent the rear side of the glass unit 40. The terminal ends of the frame side walls 52, 54 are formed with opposed channels 62, 64 for receiving and positively retaining the molding 60**.

For providing the seal between the door 11 and cabinet frame 12 when the door is in a closed position, a gasket or sealing strip 66 is secured to the rear side of the molding strip 60. The illustrated sealing strip 66 is formed with a T-shaped anchor **66*a* that is positively retained within a retaining member 68, which in turn is retained between the channels 62, 64 of the outer frame 50. The sealing strip 66 preferably contains magnets 70 for creating a magnetic attraction with the cabinet frame cover plate 22**, which may be made of stainless steel or other suitable magnetic material.

In accordance with the invention, trim panels are detachably mounted on the front of the doors and door mounting frame for providing the desired finished appearance for the door assembly, which may be color coordinated with the decor of the room or commercial establishment in which the refrigerator or freezer is installed. To this end, decorative trim panels, 75, 76, which in this case have matching generally rounded profiles, are secured to the doors 11 and door mounting frame 12, respectively, so as to overly and completely encompass the otherwise forwardly exposed portions of the frames 50, 15.

The trim panel 75, which preferably is made of PVC or other plastic material, completely encompasses the front wall 51 of the door frame 50. For detachably securing the trim panel 75 to the door frame member 50, the trim panel 75 has inwardly directed mounting flanges 78, 79 at opposed ends thereof, which are generally parallel to the plane of the door panes 41, 42 and adapted for snap action engagement, respectively, in a notch 80 in the frame 50 located at the approximate juncture between the outer and front walls 52, 51 and a notch 81 formed on the underside of the front wall 51 at the opposite end thereof. The outwardly rounded contour of the trim panel 75 provides the desired finished appearance about the perimeter of the door 11 and further defines an insulating air space 85 between the trim panel 75 and the front wall 51 of the door frame 50. For rigidifying the trim panel 75 and stabilizing its mounting on the door frame 50, the trim panel 75 has an integrally formed, rearwardly extending wall 86 located midway between its ends which abutts against the front wall 51 of the door frame 50.

The trim panel 76 for the door mounting frame 12 similarly has an outwardly curved contour that completely encompasses the front wall 16 of the frame member 15. The trim panel 76 in this instance has a rearwardly extending wall portion 88 that terminates with an inwardly directed flange 89 for releasable engagement in an outwardly opening notch 90 formed in the web 19 of the frame member 15. The opposite end of the trim panel 76 has an inwardly directed mounting flange 91 adapted for snap action engagement under a terminal end of the front wall 16 of the frame member 15. The trim panel 76 similarly has an integrally formed, rearwardly extending reinforcing wall 94 midway between its ends adapted for abutting engagement with the front wall 16 of the frame member 15.

It will be understood that the trim panels 75, 76 may be inexpensively molded of plastic or like material with any desired color or configuration so as to permit custom designing of the refrigerator or freezer installation with the decor of the commercial establishment in which it is to be located. Likewise, in the event of remodeling of such establishment, the appearance of the refrigerator or freezer installation may be easily changed to conform with the new decor simply by removing the trim panels 75, 76 and replacing them with panels of the desired color and configuration. For example, as shown in FIG. 3, in lieu of the decorative trim panels 75, 76, panels **75*a*, 76*a*** of a colonial design having substantially flat front faces may be mounted on the frames with the front faces in relatively close relation thereto. Moreover, since the doors and mounting frames incur considerable abuse in commercial establishments, upon wear or damage of the panels, the panels can be easily replaced on a regular basis so as to maintain the door assembly with a relatively fresh new appearance.

I claim as my invention:

1. A refrigerator door assembly mountable in an opening of a refrigerator cabinet comprising a door mounting cabinet frame having a front wall positionable against said cabinet adjacent said opening, at least one insulated glass door supported by said cabinet frame for relative movement, said insulated glass door including a glass unit made of a plurality of glass planes disposed in side by side relation with an air space therebetween, a door frame surrounding and supporting the periphery of said glass unit, said door frame having a front wall for retaining a front side of said glass unit and means for retaining a rear side of said glass unit, means interconnecting said front wall and said rear side retaining means with said glass unit securely retained therebetween, a first trim panel detachably mounted on said door frame in overlying relating to the front wall thereof, a second trim panel detachably mounted on said cabinet frame in overlying relation to the front wall thereof, said first panel and door frame having means for permitting removal of said first trim panel from said door frame without disassembly of the door frame and while leaving the front and rear sides of said glass unit securely retained by said front wall and said rear side retaining means of said door frame, and said second trim panel and cabinet frame having means for permitting removal of said second trim panel from said cabinet frame without disassembly of said cabinet frame.

2. The refrigerator door assembly of claim 1 in which said trim panels are made of plastic.

3. The refrigerator door assembly of claim 1 in which said trim panels each have inwardly directed retaining flanges at opposed ends thereof for releasable engagement with the respective door and cabinet frame.

4. The refrigerator door assembly of claim 1 in which said trim panels each have an outwardly curve contour which defines a dead air space between the trim panel and the front wall of the respective door and cabinet frame.

5. The refrigerator door assembly of claim 1 in which said trim panels each have a substantially flat front face.

6. The refrigerator door assembly of claim 5 in which said trim panels are mounted on said door and cabinet frames with said front face in closely spaced relation to the respective front wall of the door and cabinet frame.

7. The refrigerator door assembly of claim 3 in which said retaining flanges are disposed in planes parallel to the glass panes of said glass unit.

8. The refrigerator door assembly of claim 1 in which said trim panels each have an outwardly curve contour which defines a dead air space between the trim panel and the front wall of the respective door and cabinet frame and inwardly extending retaining flanges at opposed ends thereof for releasable engagement with the respective door and cabinet frame.

9. An insulated door for mounting in a cabinet frame comprising a glass unit made of a plurality of glass planes disposed in side by side relation with an air space therebetween, a door frame surrouding and supporting the periphery of said glass unit, said door frame having a front wall for retaining a front side of said glass unit, means for retaining a rear side of said glass unit in said door frame, means interconnecting said front wall and said rear side retaining means with glass unit securely retained therebetween, a trim panel detachable mounted on said door frame in overlying relation to said front wall for providing the desired finished appearance of said door when viewed from a front side thereof, and said trim panel and said door frame having means for permitting removal of said trim panel from said door frame without disassembly of the door frame and while leaving the front and rear sides of said glass unit securely retained by said front wall and said rear side retaining means of said door frame.

10. The insulated door of claim 9 in which said trim panel is made of plastic.

11. The insulated door of claim 9 in which said trim panel has inwardly extending retaining flanges at opposed ends thereof for releasable engagement with said door frame.

12. The insulated door assembly of claim 11 in which said trim panel has an outwardly curve contour which defines a dead air space between the trim panel and the front wall of said door frame.

13. The insulated door of claim 11 in which said trim panel has a substantially flat front face.

14. The insulated door of claim 12 in which said trim panel has an integrally formed rearwardly extending reinforcing wall disposed in abutting relation to the front wall of the door frame.

15. A refrigerator door frame assembly mountable in an opening of a refrigerator cabinet comprising a metallic structural frame member, a plurality of insulated glass doors, said insulated glass doors each including a glass unit made of a plurality of glass planes disposed in side by side relation with an air space therebetween, a door frame surrouding and supporting the periphery of each glass unit, means supporting said insulated glass doors on said frame member for relative movement, said frame member having a web portion positionable along the periphery of said cabinet opening and a front wall positionable against said cabinet adjacent said opening, a trim panel detachably mountable on said frame member in overlying relation to said front wall for providing the desired finished appearance of said frame assembly when viewed from a front side thereof, said trim panel being made of plastic and having inwardly extending retaining flanges at opposed ends thereof for engagement with said frame member, and said trim panel and frame member having means for permitting disengagement of said retaining flanges from said frame member to enable removal of said trim panel from said frame member without effecting the support of said insulated glass doors by said frame member.

16. The refrigerator door frame assembly of claim 15 in which said trim panel has an outwardly curve contour which defines a dead air space between the trim panel and the front wall of said frame member.

17. The refrigerator door frame assembly of claim 15 in which said trim panel has a substantially flat front face.

18. The refrigerator door frame assembly of claim 15 in which said trim panel has a rearwardly extending wall overlapping at least a portion of said frame member web portion.

19. A refrigerator door assembly mountable in an opening of a refrigerator cabinet comprising a door mounting cabinet frame having a front wall positionable against said cabinet adjacent said opening, at least one insulated glass door mounted in said cabinet frame, said insulated glass door including a glass unit made of a plurality of glass planes disposed in side by side relation with an air space therebetween, a door frame surrounding and supporting the periphery of said glass unit, said door frame having a front wall for retaining a front side of said glass unit, a first trim panel detachably mounted on said door frame in overlying relation to the front wall thereof, a second trim panel detachably mounted on said cabinet frame in overlying relation to the front wall thereof, and said trim panels each having an outwardly curve contour which defines a dead air space between the trim panel and the front wall of the respective door and cabinet frame and an integrally formed rearwardly extending reinforcing wall disposed in abutting relation to the front wall of the respective door and cabinet frame.

20. A refrigerator door assembly mountable in an opening of a refrigerator cabinet comprising a door mounting cabinet frame having a front wall positionable against said cabinet adjacent said opening, at least one insulated glass door mounted in said cabinet frame, said insulated glass door including a glass unit made of a plurality of glass planes disposed in side by side relation with an air space therebetween, a door frame surrounding and supporting the perphery of said glass unit, said door frame having a front wall for retaining a front side of said glass unit, a first trim panel detachably mounted on said door frame in overlying relation to the front wall thereof, a second trim panel detachably mounted on said cabinet frame in overlying relation to the front wall thereof, said trim panels each having inwardly directed retaining flanges at opposed ends thereof for releasable engagement with the respective door and cabinet frame, said door frame including an end wall extending rearwardly of said front wall, said door frame being formed with a notch at the approximate juncture of said front and end walls, and said first trim panel being mounted on said door frame with one of the retaining flanges thereof engaging said door frame notch and the other of the retaining flanges thereof engaging an innermost side of said door frame front wall.

21. A refrigerator door assembly mountable in an opening of a refrigerator cabinet comprising a door mounting cabinet frame having a front wall positionable against said cabinet adjacent said opening, at least one insulated glass door mounted in said cabinet frame, said insulated glass door including a glass unit made of a plurality of glass planes disposed in side by side relation with an air space therebetween, a door frame surrounding and supporting the periphery of said glass unit, said door frame having a front wall for retaining a front side of said glass unit, a first trim panel detachably mounted on said door frame in overlying relation to the front wall thereof, a second trim panel detachably mounted on said cabinet frame in overlying relation to the front wall thereof, said trim panels each having inwardly directed retaining flanges at opposed ends thereof for releasable engagement with the respective door and cabinet frame, said cabinet frame being formed with a notch adjacent said cabinet opening, and said second trim panel is mounted on said cabinet frame with one of the retaining flanges thereof engaging said cabinet frame notch and the other of the retaining flange thereof engaging an outermost side of the cabinet frame front wall.

22. A refrigerator door assembly mountable in an opening of a refrigerator cabinet comprising a door mounting cabinet frame having a front wall positionable against said cabinet adjacent said opening, at least one insulated glass door mounted in said cabinet frame, said insulated glass door including a glass unit made of a plurality of glass planes disposed in side by side relation with an air space therebetween, a door frame surrounding and supporting the periphery of said glass unit, said door frame having a front wall for retaining a front side of said glass unit, a first trim panel detachably mounted on said door frame in overlaying relation to the front wall thereof, a second trim panel detachably mounted on said cabinet frame in overlying relation to the front wall thereof, said trim panels each having inwardly directed retaining flanges at opposed ends thereof for releasble engagement with the respective door and cabinet frame, said retaining flanges being disposed in planes parallel to the glass panes of said glass unit, said cabinet frame having a web portion extending rearwardly of the front wall thereof into said cabinet opening and a rear wall extending inwardly into the cabinet opening from said web portion for defining a stop surface for said door, and said cabinet frame web portion being formed with a notch for receiving one of the retaining flanges of the trim panel mounted thereon.

23. A refrigerator door assembly mountable in an opening of a refrigerator cabinet comprising a door mounting cabinet frame having a front wall positionable against said cabinet adjacent said opening, at least one insulated glass door mounted insaid cabinet frame, said insulated glass door including a glass unit made of a plurality of glass planes disposed in side by side relation with an air space therebetween, a door frame surrounding and supporting the periphery of said glass unit, said door frame having a front wall for retaining a front side of said glass unit, a first trim panel detachably mounted on said door frame in overlying relation to the front wall thereof, a second trim panel detachably mounted on said cabinet frame in overlying relation to the front wall thereof, said trim panels each having an outwardly curved contour which defines a dead air space between the trim panel and the front wall of the respective door and cabinet frame and inwardly extending retaining flanges at opposed ends thereof for releasable engagement with the respective door and cabinet frame, and said trim panels each having an integrally formed rearwardly extending reinforcing wall disposed in abutting relation to the front wall of the respective door and cabinet frame.

24. An insulated door for mounting in a abinet frame comprising a glass unit made of a plurality of galss planes disposed in side by side relation with an air space therebetween, a door frame surrounding and supporting the periphery of said glass unit, said door frame having a front wall for retaining a front side of said glass unit, means for retaining a rear side of said glass unit in said door frame, a trim panel detachably mounted on said door frame in overlying relation to said front wall for providing the desired finished appearance of said door when viewed from a front side thereof, said trim panel having an outwardly curved contour which defines a dead air space between the trim panel and the front wall of the door frame, said trim panel having inwardly extending retaining flanges at opposed ends thereof for releasable engagement with said door frame, said door frame including an end wall extending rearwardly of said front wall, said door frame being formed with a notch at the approximate juncture of said front and end walls, and said trim panel being mounted on said door frame with one of said retaining flanges engaging said door frame notch and the other of said retaining flanges engaging an innermost side of said door frame front wall.

25. A refrigerator door frame assembly mountable in an opening of a refrigerator cabinet for supporting a plurality of insulated glass doors each having a glass unit made up of a plurality of glass panes disposed in side by side relation with an air space therebetween comprising a metallic structural frame member, said frame member having a web portion positionable along the periphery of said cabinet opening and a front wall positionable against said cabinet adjacent said opening, a trim panel detachable mountable on said frame member in overlying relation to said front wall for providing the desired finished appearance of said frame assembly when viewed from a front side thereof, said trim panel having inwardly extending retaining flanges at opposed ends thereof for releasable engagement with said frame member, and said trim panel having an outwardly curve contour which defines a dead air space between the trim panel and the front wall of said frame member and an integrally formed rearwardly extending reinforcing wall disposed in abutting relation to the front wall of said frame member.

26. A refrigerator door frame assembly mountable in an opening of a refrigerator cabinet for supporting a plurality of insulated glass doors each having a glass unit made up of a plurality of glass panes disposed in side by side relation with an air space therebetween comprising a metallic structural frame member, said frame member having a web portion positionable along the periphery of said cabinet opening and a front wall positionable against said cabinet adjacent said opening, a trim panel detachably mountable on said frame member in overlying relation to said front wall for providing the desired finished appearance of said frame assembly when viewed from a front side thereof, said trim panel having a inwardly extending retaining flanges at opposed ends thereof for releasable engagement with said frame member, and said frame member web portion being formed with a notch for receiving one of said trim panel retaining flanges.

* * * * *